US005823743A

United States Patent [19]

Faulkner

[11] Patent Number: 5,823,743

[45] Date of Patent: Oct. 20, 1998

[54] ROTOR ASSEMBLY FOR USE IN A TURBOMACHINE

[75] Inventor: Andrew R. Faulkner, Leicester, United Kingdom

[73] Assignee: European Gas Turbines Limited, Lincoln, United Kingdom

[21] Appl. No.: 829,721

[22] Filed: Mar. 31, 1997

[30] Foreign Application Priority Data

Apr. 2, 1996 [GB] United Kingdom ..... 9606899

[51] Int. Cl.[6] ..... F01D 5/30; F01D 11/00

[52] U.S. Cl. ..... 416/96 R; 416/248; 416/193 A

[58] Field of Search ..... 416/96 R, 96 A, 416/97 R, 145, 190, 193 A, 219 R, 220 R, 248, 500

[56] References Cited

U.S. PATENT DOCUMENTS

| | | | |
|---|---|---|---|
| 4,177,013 | 12/1979 | Patterson et al. | 416/193 A |
| 4,183,720 | 1/1980 | Brantley | 416/193 A |
| 4,192,633 | 3/1980 | Herzner . | |
| 4,516,910 | 5/1985 | Bouiller et al. | 416/193 A |
| 4,558,988 | 12/1985 | Kisling et al. . | |
| 4,730,983 | 3/1988 | Naudet et al. . | |
| 4,875,830 | 10/1989 | Trousdell et al. | 416/193 A |
| 5,052,893 | 10/1991 | Catte . | |
| 5,257,909 | 11/1993 | Glynn et al. . | |
| 5,320,492 | 6/1994 | Bouru et al. . | |
| 5,478,207 | 12/1995 | Setc | 416/219 R |

FOREIGN PATENT DOCUMENTS

| | | | |
|---|---|---|---|
| 609128 | 9/1960 | Italy | 416/96 R |
| 2112466 | 7/1983 | United Kingdom | 416/500 |

*Primary Examiner*—Christopher Verdier
*Attorney, Agent, or Firm*—Kirschstein et al.

[57] ABSTRACT

A turbomachine is provided with a rotor assembly. A seal member 18 is mounted between a blade 12 and a rotor disc 11 of the rotor assembly, the seal member 18 rocking under centrifugal force about an axis 24 to give substantially straight line sealing contact 26, 27 therealong, e.g. with the blade 12.

19 Claims, 2 Drawing Sheets

ROTOR ASSEMBLY FOR USE IN A TURBOMACHINE

BACKGROUND OF THE INVENTION

This invention relates to a turbomachine, e.g., a gas turbine engine, and is particularly concerned with a rotor assembly for use therewith.

A rotor assembly for use in a turbomachine typically comprises a radially inner rotor disc having attached thereto a plurality of radially outer blades, said blades forming an annular array extending circumferentially around the disc. It is normal to provide for cooling of such a rotor assembly and passages for cooling fluid through the rotor disc and the turbine blades are usually provided but the presence of such passages requires the use of appropriate sealing means to minimize the loss of fluid.

In particular in the case of a gas turbine wherein a compressor supplies compressed air for cooling as well as for combustion it is necessary that leakage be kept to the absolute minimum which requires the use of highly effective sealing means.

Prior art devices have often been complicated by the need to incorporate blade-disc fastening means with the sealing arrangement, but the present invention utilizes a relatively simple sealing arrangement which nonetheless works very effectively in practice and does not itself involve a blade-disc fastening arrangement. Any convenient fastening arrangement may, in fact, be utilized.

SUMMARY OF THE INVENTION

According to the present invention there is provided a rotor assembly for use in a turbomachine, the rotor assembly comprising a radially inner rotor disc to which a plurality of radially outer blades are attached and a respective seal member provided intermediate each blade and the rotor disc, wherein each seal member is mounted so as to be pivotable under centrifugal force about an axis, which axis is defined by a substantially straight line of contact of the seal member with one of the disc and the blade, the substantially straight line of contact also defining a first sealing engagement between the seal member and the one of the disc and the blade, and wherein when the seal member in use pivots under the centrifugal force about said axis, it moves into a second sealing engagement with the other of the disc and the blade.

In a preferred arrangement the blade has a generally radially inwardly extending formation which provides a substantially straight edge providing said substantially straight line of contact with the seal member. The formation may be of generally rectangular cross-section and the seal member may have a planar surface which engages with the substantially straight edge defined by the formation.

Further the seal member may have at least one projection extending radially outwardly from the planar surface, said projection being co-operable with the blade to restrict movement of the seal member in the axial direction of the rotor assembly.

In an alternative arrangement, a formation of generally V-shaped cross-section is provided with the apex of the V constituting said edge and with the seal member having a pair of substantially planar surfaces which form a generally V-section recess. With this arrangement the included angle of the V of the V-shaped recess is greater than the included angle of the V of the V-section formation, and the apex of the V-section recess and the apex of the V-section formation will co-operate to provide said first sealing engagement.

In this arrangement the generally V-section recess and/or the generally V-section formation are preferably non-symmetrical relative to a line bisecting the angle between the legs of the V.

To manufacture a rotor assembly with a V-sectioned formation as delineated above, each seal member may initially be formed as an integral part of a respective blade and be subsequently cut away therefrom, e.g., utilising a wire erosion method.

Preferably, the radially inner part of the seal member has a curved surface for sealing with a correspondingly curved surface of the other of the disc and the blade, thereby to provide said second sealing engagement, and, measured axially of the assembly, the center of gravity of the seal member is preferably further from the curved surface than is the substantially straight edge.

In a preferred arrangement the rotor disc and each blade has a passage for cooling fluid, each said passage extending generally radially.

BRIEF DESCRIPTION OF THE DRAWINGS

Embodiments of the invention will be described by way of example with reference to the accompanying drawings wherein.

DETAILED DESCRIPTION OF EMBODIMENTS OF THE INVENTION

The rotor assembly 10 forms part of a gas turbine engine comprising a turbine, and one or more stages each comprising an annular array of stator vanes adjacent a said rotor assembly 10.

Figure 1:
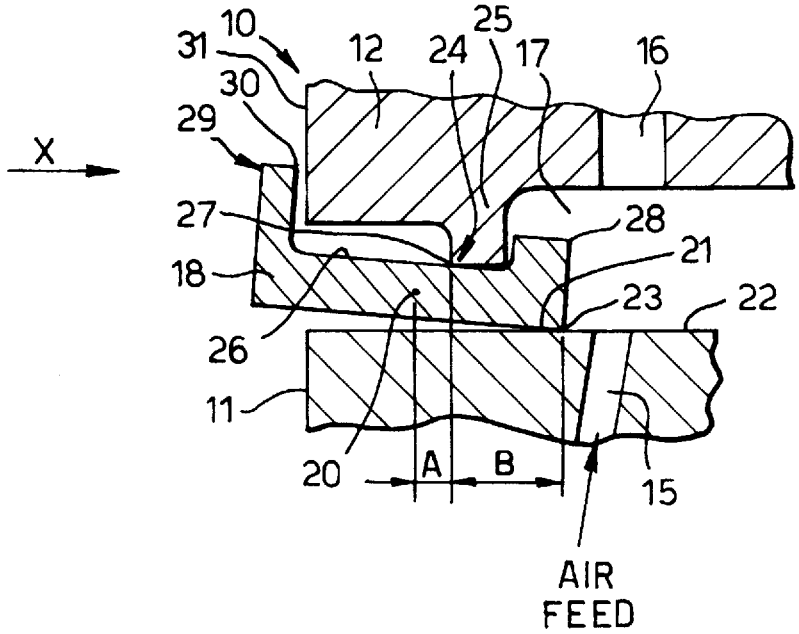
FIG. 1 is a section through a part of a rotor assembly according to the invention showing the arrangement of a seal member providing sealing between a radially inner region of a rotor blade and the radially outer region of the rotor disc when the rotor assembly is rotating.
Figure 2:
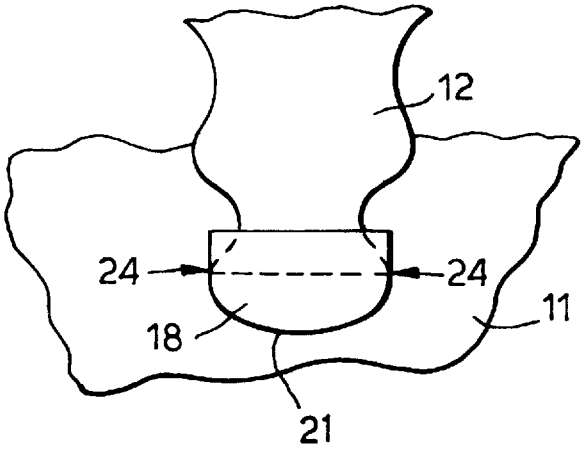
FIG. 2 shows the arrangement of FIG. 1 as viewed from one side thereof as indicated by arrow 'X' in FIG 1.

FIGS. 1 and 2 illustrate part of the radially outer region of a rotor disc 11, and part of the radially inner region of a rotor blade 12, which blade 12 is one of a plurality arranged as an annular array circumferentially around rotor disc 11 to form the rotor assembly. The radially inner region of the rotor blade 12 constitutes a blade root whereby the blade 12 is secured to the rotor disc 11 to prevent axial and/or tangential movement of the blade relative to the disc. Securing takes place at a point along the axial length of the rotor intermediate of the two ends of the disc, and at one or both ends a sealing arrangement is provided. Thus, it is envisaged that the sealing arrangement illustrated in the drawings will be employed at each end of the disc/blade assembly or at one end only with alternative sealing means at the other end. The method of securing blade 12 to disc 11 may take any appropriate form but will usually involve some form of stud and socket, male/female, lobed or 'fir-tree' fastening arrangement. The stud or male part of the fastening will usually be provided on the blade root and the socket or female part of the fastening will be provided in the rotor disc. As seen in FIG. 1, the rotor disc 11 and blade 12 have respective generally radially extending bores 15, 16 therethrough for the passage of cooling air, such cooling air having been directed to the passage 15 by the compressor of the turbine engine. For efficient operation and specifically to maximize compressor performance the interface spaces 17 between the disc 11 and the blade 12 must be sealed and a seal member 18 is provided at one or each axial end of the gap between the rotor disc and the blade.

Each seal member 18 is mounted so as to be pivotable or rockable (in a clockwise direction as seen in FIG. 1) about an axis 24 (see below) under centrifugal force as the rotor assembly rotates. Such axis 24 will be displaced from the center of gravity 20 (see FIG. 1) of the seal member.

The seal member 18 has its under-surface, as shown, i.e., its radially inner surface 21 (see FIG. 2) of convex form and with a curvature corresponding to the curvature of an outer concave surface 22 of the rotor disc. Because of the rocking motion of the seal member 18, in use, the seal member 18 and the disc 11 make sealing contact (engagement) along curved line 23. Obviously the arrangement may utilize a concave surface on member 18 and a convex surface on disc 11.

Sealing engagement between seal member 18 and blade 12 on the other hand takes place along a substantially straight line 24 which defines the axis about which the seal member pivots or rocks (see above). To that end, the blade root has a rectangular-section projection 25 extending generally radially inwardly, an edge 27 of which projection contacts a planar surface 26 of the seal member 18 to thereby constitute the axis 24. Depending on the form and dimensions of the various components, the edge 27 and the planar surface 27 could be in at least light contact even when the rotor assembly is not rotating but, in any event, when the rotor assembly rotates the seal member 18 rocks under the centrifugal force, the contact between planar surface 26 and the substantially straight edge 27 then operating so as to give sealing engagement therebetween. Thus as the rotor assembly rotates there is a (first) sealing engagement between the seal member 18 and the blade 12 at the substantially straight line of contact represented by axis 24 while at the same time there is a (second) sealing engagement between seal member 18 and disc 11 along curved line 23.

Measured axially of the assembly the center of gravity 20 of the seal member 18 is further from surface 21 than is the edge 27.

Also, as seen on FIG. 1, distance 'A' represents the distance measured axially of the assembly between the center of gravity 20 of the seal member 18 and the axis 24 and 'B' represents the axial distance between axis 24 and curved line contact 23. Clearly 'B' is greater than 'A'.

At its two ends the planar surface 26 has respective projections or toes 28, 29. These toes are not intended for sealing contact with the blade root but rather act to restrict axial movement of the seal member 18—as seal member rocks in a clockwise direction edge 30 of projection 29 will eventually contact face 31 of blade 12, though care must be taken to ensure this does not happen during normal operation.

Figure 3:
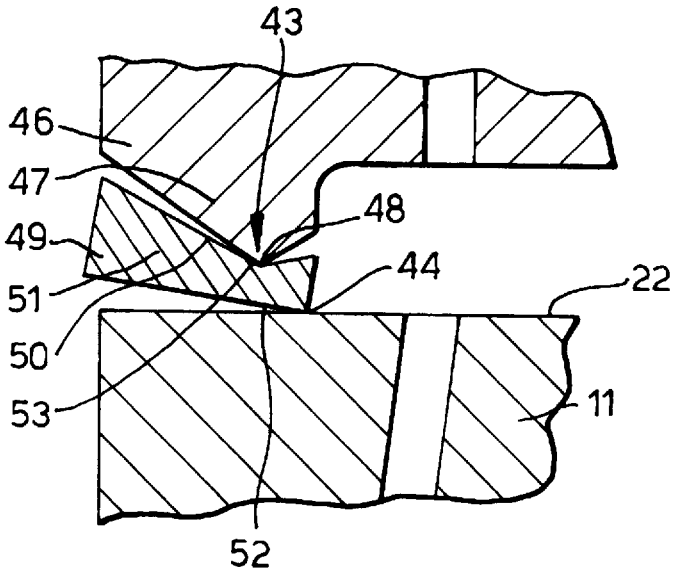
FIG. 3 is a section through a part of an alternative embodiment of a rotor assembly according to the invention.

The embodiment of FIG. 3 involves a modified form of both the seal member and the blade root. The blade root 46 is formed with a projection 47 which has a generally V-shaped but non-symmetrical cross-section.

The rockable seal member 49 on the other hand is formed at its radially outer region with a recess 50 having a generally V-shaped but non-symmetrical cross-section.

The sections of the V-shaped projection 47 and of the recess 50 are similar but not identical. The straight line sealing engagement (contact) 43 between seal member 49 and blade root 46 occurs at the apices of the projection 47 and the recess 50 which respectively provide straight edges 48, 53; to allow seal member 49 to rock about the substantially straight line of sealing engagement 43, the angle included by the legs of the V-shaped recess 50 is greater than that included by the legs of the V-shaped projection 47. The radially inner surface 52 of seal member 49, as before, is of convex form with a curvature corresponding to that of the concave surface of disc 11 to give curved line sealing engagement 44 as the seal member 49 rocks or pivots under centrifugal force.

The embodiment of FIG. 3 gives a particular manufacturing advantage. Thus the seal member 49 and the V-shaped projection 47 can initially be formed integrally e.g., by means of a locally enlarged formation of the casting of the blade. The seal member is then cut from the extra material, e.g., by a wire erosion method, to leave the projection 47 on the blade.

It is possible by appropriate construction and arrangement of the parts for the substantially straight line of contact, which acts as the pivot axis of the seal member, to be provided on the disc; in that case, of course, the second sealing engagement which occurs when the seal member rocks or pivots will be between the seal member and a suitable formation on the blade.

I claim:

1. A rotor assembly for use in a turbomachine, the rotor assembly comprising: a radially inner rotor disc to which a plurality of radially outer blades are attached, and a respective seal member which is provided intermediate each blade and the rotor disc, wherein each seal member is mounted so as to be pivotable under centrifugal force about an axis, said axis being defined by a substantially straight line of contact of the seal member provided by a substantially straight edge on one of the disc and the blade, the substantially straight line of contact also defining a first sealing engagement between the seal member and the one of the disc and the blade, and wherein, when the seal member in use pivots under said centrifugal force about said axis, the seal member moves into a second sealing engagement with the other of the disc and the blade.

2. A rotor assembly as claimed in claim 1 wherein the blade has a generally radially inwardly extending formation which provides the substantially straight edge.

3. A rotor assembly as claimed in claim 2 wherein the formation is of generally rectangular cross-section.

4. A rotor assembly as claimed in claim 3 wherein the seal member has a planar surface which engages with the substantially straight edge defined by the formation.

5. A rotor assembly as claimed in claim 4 wherein the seal member has at least one projection extending radially outwardly from the planar surface.

6. A rotor assembly as claimed in claim 5 wherein said at least one projection is co-operable with the blade to restrict movement of the seal member in the axial direction of the rotor assembly.

7. A rotor assembly as claimed in claim 2 wherein the formation is of generally V-shaped cross-section with the apex of the V constituting said edge.

8. A rotor assembly as claimed in claim 7 wherein the seal member has a pair of substantially planar surfaces which form a generally V-section recess.

9. A rotor assembly as claimed in claim 8 wherein the included angle of the V of the V-shaped recess is greater than the included angle of the V of the V-section formation.

10. A rotor assembly as claimed in claim 8 wherein the apex of the V-section recess and the apex of the V-section formation co-operate to provide said first sealing engagement.

11. A rotor assembly as claimed in claim 8 wherein the generally V-section recess and/or the generally V-section formation are non-symmetrical relative to a line bisecting the angle between the legs of the V of the V-section recess and/or of the generally V-section formation.

12. A rotor assembly as claimed in claim 1 wherein the radially inner part of the seal member has a curved surface for sealing with a correspondingly curved surface of the other of the disc and the blade, thereby to provide said second sealing engagement.

13. A rotor assembly as claimed in claim 12 wherein, measured axially of the assembly, the center of gravity of the seal member is further from the curved surface than is the substantially straight edge.

14. A rotor assembly as claimed in claim 1 wherein the rotor disc and each blade has a passage for cooling fluid.

15. A rotor assembly as claimed in claim 14 wherein each said passage extends generally radially.

16. A rotor assembly as claimed in claim 1 wherein each blade has a pair of axially spaced said seal members, cooperating with the blade and with the disc.

17. A method of manufacturing a rotor assembly for use in a turbomachine, the rotor assembly comprising a radially inner rotor disc to which a plurality of radially outer blades are attached, and a respective seal member which is provided intermediate each blade and the rotor disc, wherein each seal member is mounted so as to be pivotable under centrifugal force about an axis, said axis being defined by a substantially straight line of contact of the seal member with one of the disc and the blade, the substantially straight line of contact also defining a first sealing engagement between the seal member and the one of the disc and the blade, and wherein, when the seal member in use pivots under said centrifugal force about said axis, the seal member moves into a second sealing engagement with the other of the disc and the blade, and the blade having a generally radially inwardly extending formation of generally V-shaped cross-section with the apex of the V constituting a substantially straight edge providing said substantially straight line of contact with the seal member, the method of manufacture comprising the steps of:

(i) initially forming each seal member as an integral part of a respective said blade, and (ii) subsequently cutting the seal member away from the blade.

18. A method of manufacturing a rotor assembly as claimed in claim 17 wherein the seal member is cut away utilizing a wire erosion method.

19. A turbine machine incorporating a rotor assembly, said rotor assembly comprising a radially inner rotor disc to which a plurality of radially outer blades are attached, and a respective seal member which is provided intermediate each blade and the rotor disc, wherein each seal member is mounted so as to be pivotable under centrifugal force about an axis, said axis being defined by a substantially straight line of contact of the seal member provided by a substantially straight edge on one of the disc and the blade, the substantially straight line of contact also defining a first sealing engagement between the seal member and the one of the disc and the blade, and wherein, when the seal member in use pivots under said centrifugal force about said axis, the seal member moves into a second sealing engagement with the other of the disc and the blade.

* * * * *